United States Patent [19]

Klein et al.

[11] 4,022,572

[45] May 10, 1977

[54] HOT-BLAST FURNACE WITH FOAMED SILICATE INNER LAYER

[75] Inventors: Walter Klein, Duisburg-Rahm; Heinrich Nobis, Wiesbaden, both of Germany

[73] Assignee: Didier-Werke AG, Wiesbaden, Germany

[22] Filed: Feb. 5, 1976

[21] Appl. No.: 655,613

[30] Foreign Application Priority Data

Feb. 6, 1975 Germany ..... 2504852

[52] U.S. Cl. ..... 432/214; 110/1 A

[51] Int. Cl.[2] ..... C21B 9/00; C21B 9/06

[58] Field of Search ..... 432/214, 217, 218; 110/1 A

[56] References Cited

UNITED STATES PATENTS

| | | | |
|---|---|---|---|
| 3,528,647 | 9/1970 | Hyde | 432/217 |
| 3,625,494 | 12/1971 | Allen | 432/214 |
| 3,832,815 | 9/1974 | Balaz et al. | 110/1 A |
| 3,859,040 | 1/1975 | Shefsiek | 432/214 |

*Primary Examiner*—John J. Camby

*Attorney, Agent, or Firm*—Wenderoth, Lind & Ponack

[57] ABSTRACT

A hot-blast furnace of the type including an outer metal casing and an inner lining of insulating and refractory material has therebetween a layer of foamed glass or foamed silicate material having a structure of closed pores or small cells which are closed in an air tight manner to each other. The layer prevents passage of gas, during operation of the furnace, to the inner surface of the outer metal casing.

7 Claims, 5 Drawing Figures

HOT-BLAST FURNACE WITH FOAMED SILICATE INNER LAYER

BACKGROUND OF THE INVENTION

The present invention relates to an improved hot-blast stove of the type including an outer sheet or plate metal casing and an inner lining of insulating and refractory material as well as gas tight elements for blocking off the flow of gas toward the inner surface of the metal casing.

It is well known that the refractory lining of hot-blast stoves is not gas tight, such that gases which contain corrosive components may penetrate from the interior of the hot-blast stove to the inner surface of the metal casing and condense in such area. Condensate of this type causes corrosion which, together with the stresses present in the metal casing, leads to the so-called intercrystalline stress corrosion. This causes relatively rapidly occurring cracks and breaks in the metal casing.

German DT-AS No. 1,955,063 describes in detail the phenomenon involving intercrystalline stress corrosion and also suggests means of preventing the deposit of corrosive agents on the inner surface of the metal casing. According to this solution, a second, interior gas tight casing or lining of metal or heatresistant synthetic resin is provided within the outer metal casing and is formed in the shape of the outer metal casing.

The purpose of the inner casing is to stop the gases penetrating toward the outer metal casing through the pores and leaks of the lining.

However, practice has shown that, e.g. under careless handling, improper placement, or during the operation of the hot-blast stove, the inner lining or casing may be broken, so that the gas-blocking effect thereof may be lost.

SUMMARY OF THE INVENTION

The object of the present invention is to provide improved means for blocking of the gas flow toward the inner surface of the outer metal casing of a hot-blast stove, such means being reliable in operation and assembly.

This object is achieved in accordance with the present invention by applying a layer of foamed silicate or foamed glass material as a gas tight blocking layer or barrier in the immediate area of the inner surface of the outer metal casing.

The term foamed glass or foamed silicate material is intended to refer to the product achieved by foaming of conventional glass materials, such as boron silicates. Such product is normally formed in sheets and has a structure of closed pores or small cells which are closed in an air tight manner to each other. This structure provides good insulating properties and also results in the product being completely impermeable to gases and liquids. One example of a foamed glass or foamed silicate material which is suitable for carrying out the present invention is manufactured by Duetsche Pittsburgh Corning GmbH. under the mark "FOAMGLAS." This is exemplary only, however, and any foamed glass or foamed silicate material having the construction and properties discussed herein is intended to be within the scope of the present invention.

Although foamed glass or foamed silicate material has good mechanical strength and excellent insulating properties, its stability with regard to changes in temperature is relatively low. Therefore, until the present time the level of the art has been to not use foamed glass or foamed silicate material in installations subjected to a variable thermal load, such as hot-blast stoves that are periodically heated up and blasted cold.

However, it has unexpectedly been discovered that foamed glass or foamed silicate material may be employed as a gas tight layer in the immediate area of the inner surface of the outer metal casing, and the stressing of such layer with regard to stability under changes in temperature may be maintained below admissible load limits when the insulating and refractory material of the inner furnace lining is properly constructed, e.g. with regard to dimensions, to thermal-technical considerations, and to economic requirements. Specifically, the inner furnace should be constructed, by techniques known to those skilled in the art, in such a manner that the maximum temperature to which the foamed glass or foamed silicate layer is subjected is approximately 430° C. Temperature differences of about 250° C. occur in the hot-blast stove during the heating period, on the one hand, and during the blasting period, on the other hand. The inner furnace lining should be constructed so that the temperature difference to which the side of the foamed glass or foamed silicate layer adjacent to the inner furnace lining is subjected is approximately 40° to 50° C.

The present invention results in a gas tight layer which can be constructed jointly with the inner furnace lining with ordinary tools and devices. There need be no fear of damage to the layer during the construction of the lining. Accordingly, the impermeability of the layer is reliably provided both before the hot-blast stove is started and also during the operation thereof. The small differential expansion possibly present in material adjacent the layer and the friction thus produced can readily be overcome by the inherent properties of the layer. Furthermore, the foamed glass or foamed silicate material layer can readily bear the variable compressive stresses due to pressure changes occurring in hot-blast stoves.

In accordance with a further feature of the invention the foamed glass or foamed silicate layer may be lined on at least one side thereof with a metal or synthetic resin sheet, at least in the areas of the joints of the layer. This produces an effective gas lock when the mortar between the joints of the layer is of a material permeable to gas. The joints of the layer may also expediently be sealed with a ceramic material, e.g. water glass.

BRIEF DESCRIPTION OF THE DRAWINGS

Exemplified embodiments of the invention will be described in more detail below with reference to the accompanying drawings, wherein.

DETAILED DESCRIPTION OF THE INVENTION

Figure 1:
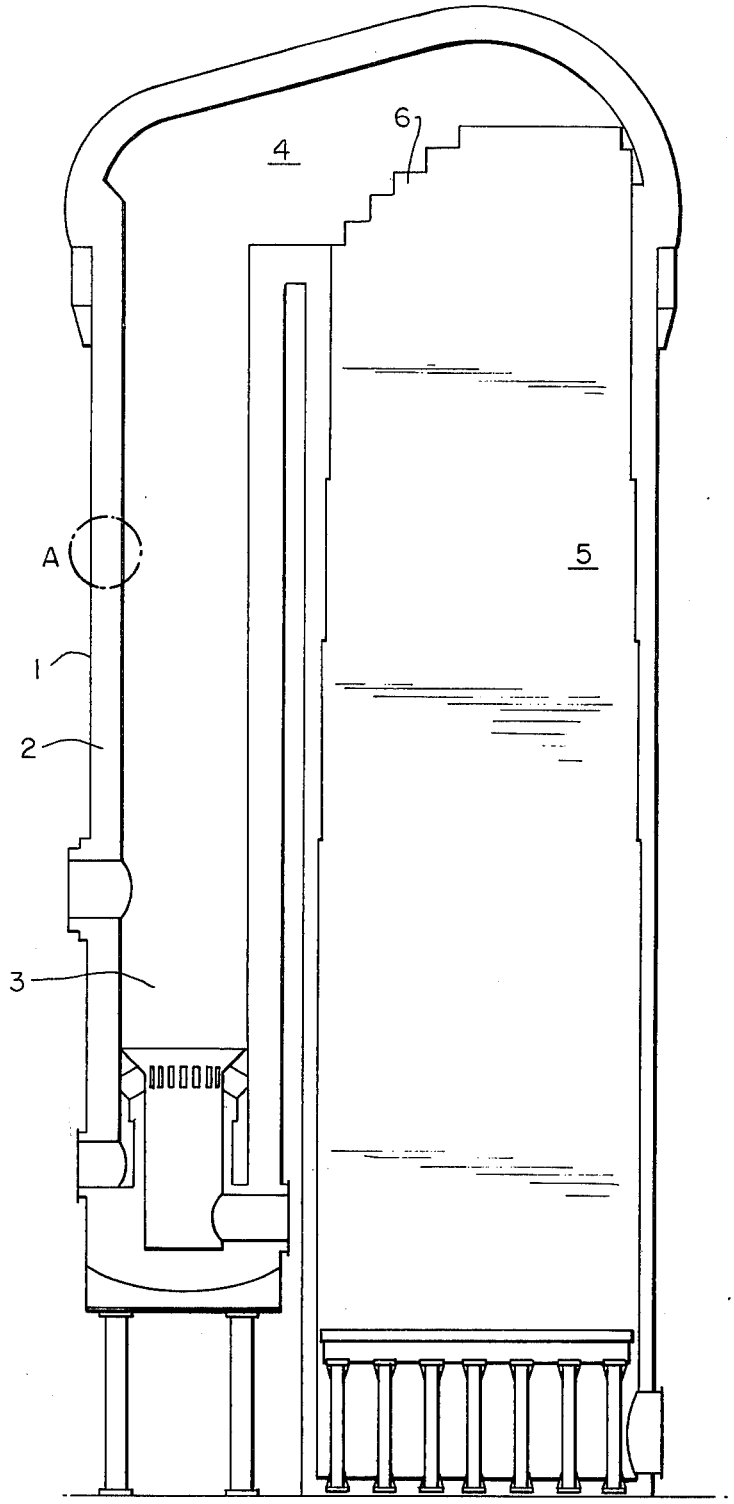
FIG. 1 is a schematic sectional view of a hot-blast stove in which the improvement of the present invention may be employed.

FIG. 1 illustrates a known hot-blast stove construction including an outer sheet or plate metal casing 1, an inner lining of insulating and refractory material 2, and a combustion shaft 3 joined to a cupola 4 by a grating shaft 5 having arranged therein a lattice grating 6.

Figure 2:
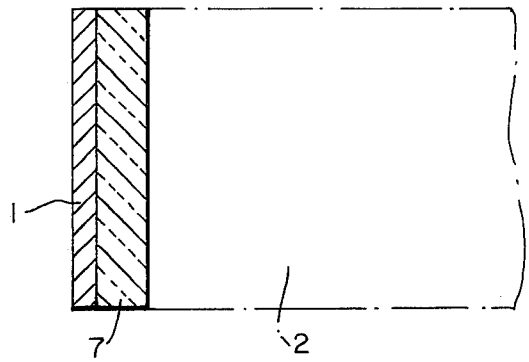
FIGS. 2 to 5 are sections, on an enlarged scale of the detail A of the hot-blast stove of FIG. 1 of different embodiments of the improvement of the invention.

According to one embodiment of the invention as illustrated in FIG. 2, one side of a gas tight foamed glass or foamed silicate layer 7 contacts the inner surface of metal casing 1, which may also be provided with a coating or other cover layer. The inner side of layer 7 is adjacent the outer surface of lining 2.

Figure 3:
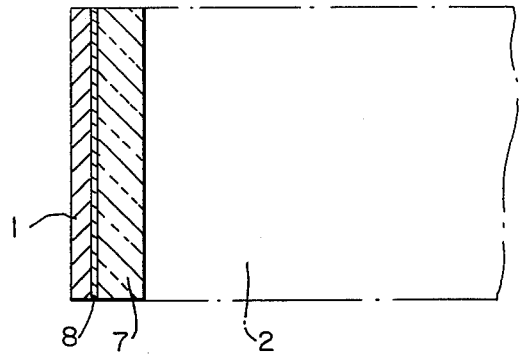
Figure 4:
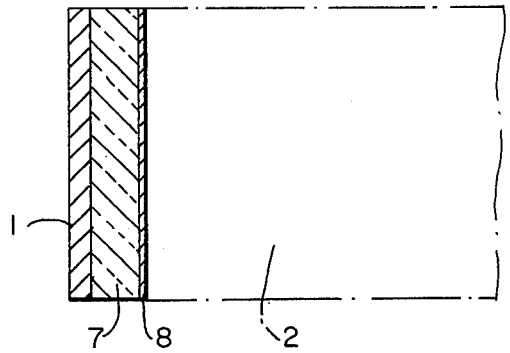
Figure 5:
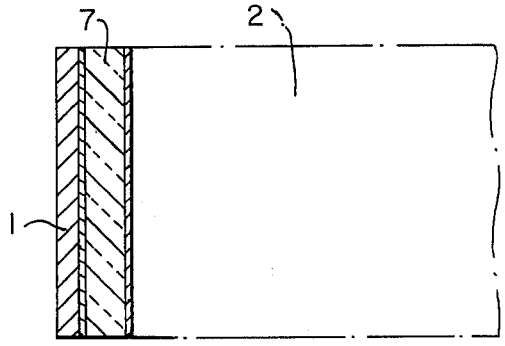

According to the embodiment of FIG. 3 and in contrast with FIG. 2, a gas tight sheet or layer 8 is provided between the inner surface of metal casing 1 and layer 7. As seen in FIG. 4, layer 8 may also be arranged between layer 7 and lining 2. Also, layers 8 can also be provided on both sides of layer 7 as shown in FIG. 5.

Sheets 8 are of gas tight metal or synthetic resin material and primarily are provided to cover the joints of layer 7, to thereby insure the gas-tightness of the overall layer, especially in the area of the joints thereof.

Grating 6 of the hot-blast stove is alternatively heated by the hot gases produced in combustion shaft 3 and then blasted cold during the heating of the blast required for the blast furnace. During both phases, gases penetrate lining 2 to layer 7, where their path to casing 1 is blocked. Under special operating conditions, wherein condensate might unexpectedly be deposited on the inner side of layer 7, the penetration of such condensate to the casing 1 would be prevented, since the foamed glass or foamed silicate layer 7 is also impervious to liquids. The inner surface of the casing 1 is thus not exposed to the attack of corrosive materials.

It will be apparent that various modifications may be made to the above specifically described arrangement without departing from the scope of the invention.

What is claimed is:

1. In a hot-blast stove or furnace of the type including an outer metal casing and an inner lining of insulating and refractory material, the improvement comprising:

means, positioned in an area immediately adjacent the inner surface of said outer metal casing, for preventing gas flow during the operation of said stove or furnace from contacting or condensing on said inner surface of said outer metal casing, said preventing means comprising a layer of foamed glass or foamed silicate material having a structure of closed pores or cells which are closed in a gas tight and liquid tight manner to each other, said layer being impermeable to the passage therethrough of gas or liquid.

2. The improvement claimed in claim 1, wherein said layer is positioned between said outer metal casing and said inner lining.

3. The improvement claimed in claim 1, wherein said layer is formed by sheets of said material with joints between said sheets.

4. The improvement claimed in claim 3, wherein said joints are sealed by a ceramic material.

5. The improvement claimed in claim 3, further comprising sheets of gas impervious sealing material covering at least one side of said layer at least in the areas of said joints.

6. The improvement claimed in claim 5, wherein said gas impervious sealing material comprises a metal.

7. The improvement claimed in claim 5, wherein said gas impervious sealing material comprises a synthetic resin.

* * * * *